US006126485A

United States Patent [19]

Shobara et al.

[11] Patent Number: 6,126,485

[45] Date of Patent: Oct. 3, 2000

[54] FLANGED CONNECTOR

[75] Inventors: Yoshitaka Shobara, Yokohama; Masato Kato, Sagamihara, both of Japan

[73] Assignee: Japan Solderless Terminal MFG, Co., Ltd., Osaka, Japan

[21] Appl. No.: 09/394,623

[22] Filed: Sep. 13, 1999

[30] Foreign Application Priority Data

Sep. 14, 1998 [JP] Japan ..... 10-259624

[51] Int. Cl.[7] ..... H01R 13/648

[52] U.S. Cl. ..... 439/607; 439/564

[58] Field of Search ..... 439/607, 439, 439/564, 573, 609, 610

[56] References Cited

U.S. PATENT DOCUMENTS

| | | | |
|---|---|---|---|
| 5,637,014 | 6/1997 | Sukegawa et al. | 439/607 |
| 5,865,646 | 2/1999 | Ortega et al. | 439/607 |
| 5,957,726 | 9/1999 | Belopolsky et al. | 439/607 |

*Primary Examiner*—Gary F. Paumen
*Assistant Examiner*—Phuongchi Nguyen
*Attorney, Agent, or Firm*—Antonelli, Terry, Stout & Kraus, LLP

[57] ABSTRACT

A flanged connector (20) has an insulating housing (21), a plurality of contacts (22) separated one from another within the housing, a metal shell (23) covering the housing so as to shield the contacts, and at least one flange (28) bent at and outwardly extending from at least one of edges of a front opening (24) formed in the metal shell. A female-threaded bore (30) is formed in each flange (28), which continues from a folded-back portion (27). This portion is formed by bending outwards and further bending rearwards an extension from the at least one edge so that the flange is or the flanges are retracted from the edges a predetermined distance. A pair of the flanges (28) may extend along the opposite side edges of the opening (24), or alternatively the single flange (28) may extend along an upper one of those edges. The flanged connector (20), which will be fixed by one or more set-screws (9) to a panel (10) of an electric or electronic apparatus's body, has thus those flanges (28) made as small as possible to reduce a space necessary for the connector to be surface-mounted.

11 Claims, 6 Drawing Sheets

FLANGED CONNECTOR

BACKGROUND OF THE INVENTION

1. Field of the Invention

The present invention relates to a flanged connector that will serve as an interface which is surface-mounted on a printed circuit board installed in a body of a personal computer (hereinafter referred to as 'PC') or the like, so that any peripheral unit or device such as a key board, a mouse, a printer, a modem or a scanner may electrically be connected to the PC through a plugging cable.

2. Prior Art

The connectors of this kind have been provided in accordance with the standard 'IEEE 1394' (applied to the high speed serial buses). Basically, these prior art connectors comprise each an insulating housing, a plurality of contacts isolated therein one from another and a metal shell covering the housing so as to shield the contacts. Also known in the art are certain types of flanged connectors each having a flange or a pair of flanges which are formed by bending outwards and extending sideways the metal shell's portion or portions adjacent to a front opening formed through said shell. Those flanges are designed to protect the connector's soldered regions from stress when a mating plug is pushed in or pulled off the connector.

FIGS. 7 and 8 show the prior art flanged connectors, respectively in their use.

As seen in FIG. 7, one of those flanged connectors 1 comprises an insulating housing 2, discrete contacts 3 isolated one from another within the housing 2, and a metal shell 4 covering the housing 2 and shielding the contacts 3. The connector further comprises flanges 6 that are formed each by bending outwards and extending sideways a shell's portion located adjacent to a front opening 5 of said sell. Short cylinders 7 are formed by burring the flanges 6, and internally threaded to provide female-threaded bores 8. Set-screws 9 will be fastened in and through the threaded bores 8 so as to fix the flanges 6 on a PC main body's panel 10, securing thereto the flanged connector. The contacts 3 have their lead ends 3*a* protruding backwards from the housing 2 and bent downwards. The metal shell 4 has anchor legs 4*a* formed integral therewith and protruding downwards from opposite sides of the shell and beyond a lower face thereof Those lead ends 3*a* and anchor legs 4*a* will be soldered to the printed circuit board 11, thus surface-mounting the connector thereon.

In use, a mating plug 12 attached to a cable end will be inserted in the flanged connector 1, through its front opening 5. The set-screws 9 should not collide or interfere with the plug's opposite sides when bringing the cable and the connector into electric connection. Therefore, it has been compulsory to design the flanges 6 such that set-screws 9 would be positioned transversely away from the respective opposite sides 12. Such a design has however resulted heretofore in a larger space for surface-mounting the connector 1 as a whole including its flanges 6, even if its body itself would have been of a relatively small size.

The other type of the known flanged connector '1A' shown in FIG. 8 has a single flange 6 bent at and extending outwards from an upper edge of the front opening 5. Also in this case, the set-screw 9 should not interfere with an upper face of the mating plug 12 when bringing the cable and the connector 1A into electric connection. Thus, the flange 6 had likewise to be designed such that the set-screw 9 would be positioned upwards away from the upper face of the plug 12.

This design has also resulted in a comparatively larger space for surface-mounting the connector 1A as a whole including its flange 6, even if the connector body had been of a relatively small size.

SUMMARY OF THE INVENTION

An object of the present invention made in view of those drawbacks inherent in the prior art is to provide a flanged connector comprising either a single flange or a pair of flanges that is or are positioned rearward relative to a front opening of the connector, to such an extent that a mating plug attached to a cable will not interfere with a set-screw or respective set-screws when the connector receives the plug for electric connection therewith being inserted through the opening. This feature will be effective to reduce distance by which the flange or flanges protrude transversely from the connector body, thus decreasing a space necessary for the connector in its entirety to be surface-mounted.

In order to achieve this object, the flanged connector provided herein will comprise an insulating housing, a plurality of contacts separated one from another within the housing, a metal shell covering the housing so as to shield the contacts, a single flange or a pair of flanges bent at and outwardly extending from an edge or opposite edges of a front opening formed in the metal shell, and a female-threaded bore formed in the single or each flange, wherein the single or each flange continues from a folded-back portion that is formed by bending outwards and further bending rearwards an extension from the edge so that the flange is retracted translationally from said edge a predetermined distance (and at least the thickness of a panel included in a main body that constitutes a 'PC' or the like).

The pair of flanges may be located along the opposite edges of the front opening, and the single flange may be located along the upper edge of said opening.

The flange or flanges retracted the predetermined distance from the metal shell's front opening can now be fixed to the main body's panel by means of a set-screw or set-screws, without causing the latter to interfere with a mating plug attached to a cable. By virtue of this feature, transverse protrusion of the flange or flanges is now rendered smaller to reduce a space necessary for the connector as a whole to be surface-mounted. The folded-back portion or portions for ensuring such a retracted position to the flange or flanges is or are of an increased strength as compared with the remainder regions of the shell, and protrude forwards to advantageously serve as a guide or guides for the mating plug being inserted through the shell's opening.

THE PREFERRED EMBODIMENTS

Figure 1:
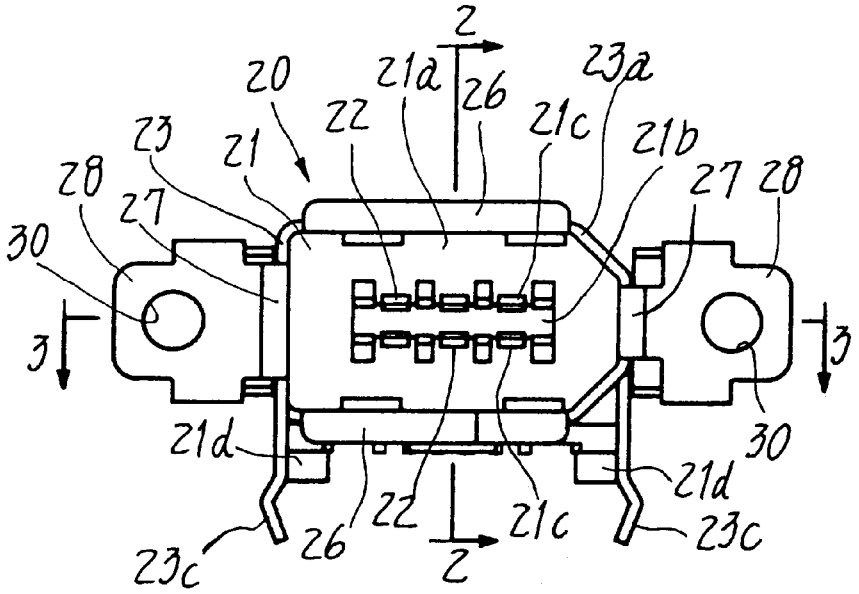
FIG. 1 is a front elevation of a flanged connector provided in a first embodiment of the present invention.

Some preferable embodiments of the present invention will now be described referring to the drawings.

Figure 2:
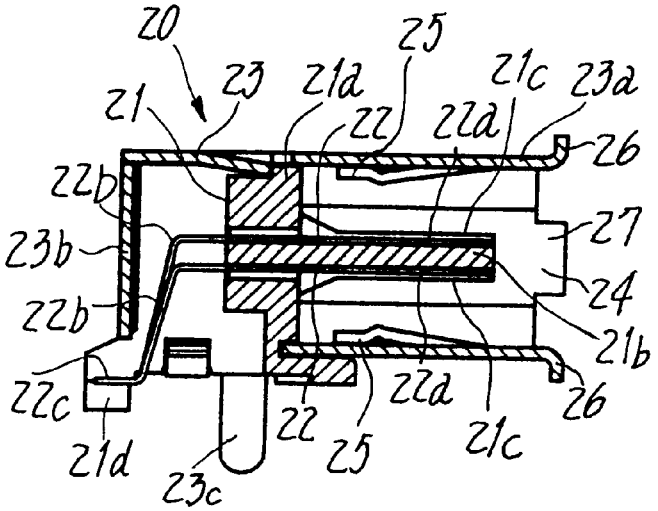
FIG. 2 is a cross section taken along the line 2—2 in FIG. 1.
Figure 3:
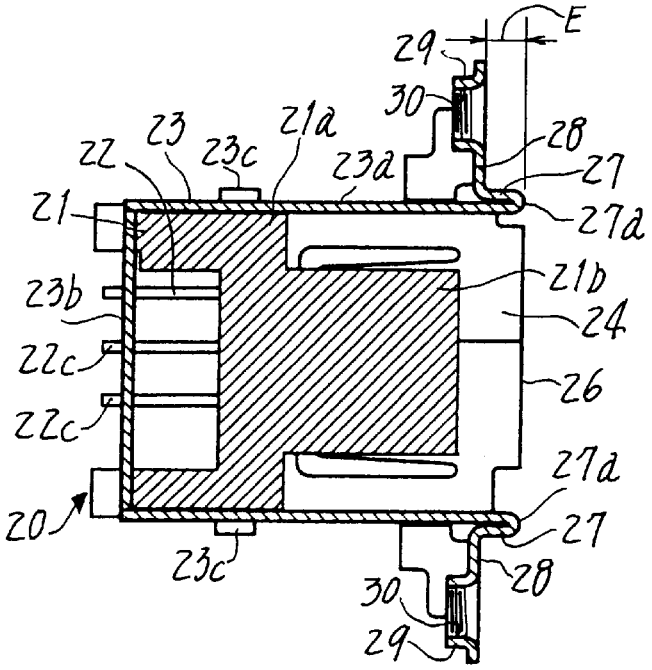
FIG. 3 is a cross section taken along the line 3—3 in FIG. 1.

FIGS. 1 to 3 show a flanged connector provided in a first embodiment of the invention. This connector 20 comprises an insulating housing 21, a plurality of female contacts 22 arranged in an upper and lower rows and isolated one from another. The connector further comprises a metal shell 23 enclosing the metal shell 23 almost completely except for a front face thereof.

The housing 21 made of an insulating plastics comprises a body 21*a* and a central partition 21*b*, which partition extends protrudes forwards from a middle region of the body 21*a*. A plurality of contact-receiving chambers 21*c* are formed in parallel to each other within the housing, so as to extend from behind the body 21*a* thereof and then forwardly along the upper and lower faces of the partition 21*b*. Bosses 21*d* protruding down from opposite sides of the housing body 21*a* are intended to fit in respective positioning slots formed in a printed circuit board.

The female contacts 22 are formed by stamping out raw pieces from a thin conductive metal sheet such as a phosphor bronze sheet, and then bending each piece. Each contact 22 comprises a contacting portion 22*a* and a lead portion 22*b*, so that male contacts (not shown) of a mating plug 12 (see FIG. 4) attached to a cable end are allowed to mate with the respective contacting portions. The lead portions 22*b* continue backwards from rear ends of the contacting portions 22*a* and are then bent downwards, wherein rearward ends of such lead portions are to be soldered to any base or the like. The contacting portions 22*a* are accommodated in the repective chambers 21*a* in the housing 21, thus placing the contacts 22 in parallel with each other and isolated one from another.

Figure 4:
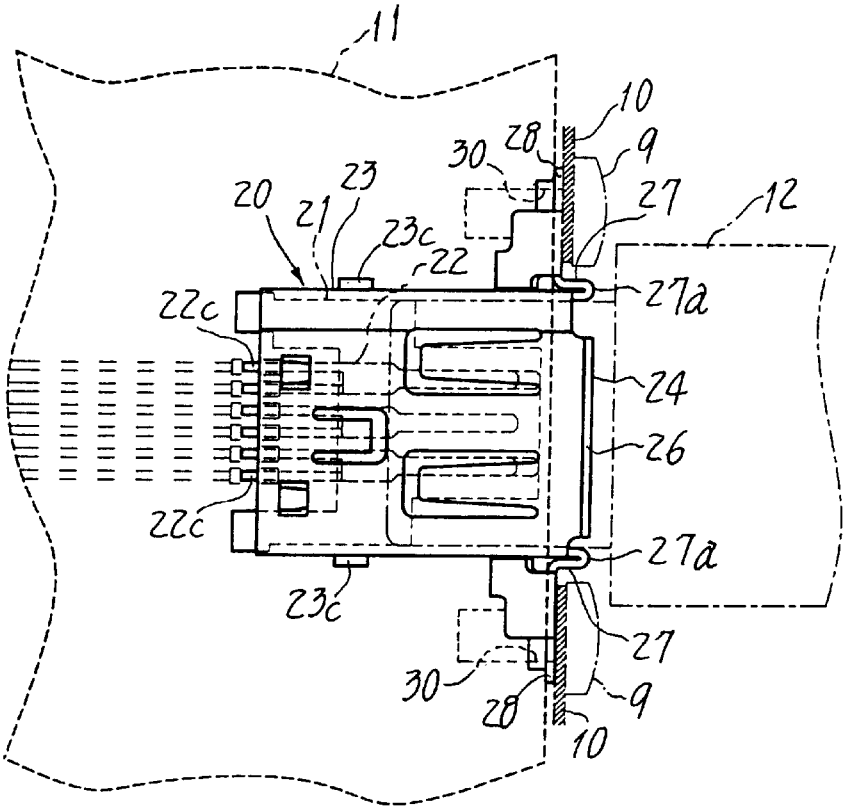
FIG. 4 is a plan view of the flanged connector shown in use.

The metal shell 23 may be made by stamping raw pieces out of a copper alloy sheet or the like, with each piece undergoing a subsequent bending process. A cylindrical main part 23*a* and a rear part 23*b* constitute the metal shell, wherein the former part encloses the housing body 21*a* and the central partition 21*b* so as to cover their upper and lower faces and their opposite sides. The rear face of the housing body 21*a* is covered with the rear part 23*b*, which thus cooperates with the main part of the metal shell to shield both the contacting and lead portions 22*a* and 22*b* of each contact 22. Front edges of the cylindrical main part 23*a* define a rectangular opening 24 serving as an entrance for the mating plug 12. Resilient tongues 25 are opened up in the upper and lower faces of the main part 23*a* of the metal shell, so that a housing of the mating plug 12 is elastically kept in position by said tongues. Anchor legs 23*c* and 23*c* that protrude from rearward opposite side portions of the main part 23*a* will fit in slots formed in the printed circuit board, to be soldered thereto. An upper and lower edges 26 and 26 defining the opening 24 in the main part 23*a* are bent outwards to provide arcuate or rounded corners that will smoothly guide the mating plug 12. On the other hand, opposite side edges of the main part 23*a* also defining the opening 24 are bent sideways and then rearwards such as to provide folded-back portions 27 from which flanges 28 continue to extend sideways. As seen in FIGS. 3 and 4, those folded-back portions 27 are designed such that the flanges 28 are retracted from the four side edges surrounding the opening 24. A predetermined distance 'E' by which the flanges are retracted in a translational fashion is substantially equal to the sum of thickness of a main body's panel 10 (in the 'PC' or the like) and height of each set-screw's 9 head. Those flanges 28 protruding sideways from the shell's opposite sides, with the opening 24 intervening between said flanges that extend in a direction substantially perpendicular to that in which the mating plug 12 will be inserted. Central regions of the flanges 28 are burred to provide short cylinders 29, which are further processed to have female threads 30 mating with the set-screws 9. Frontal tip ends 27*a* of the folded-back portions 27 are substantially in flush with outer faces of the upper and lower arcuate corners 26, whereby the mating plug 12 can easily be guided into the connector.

Figure 7:
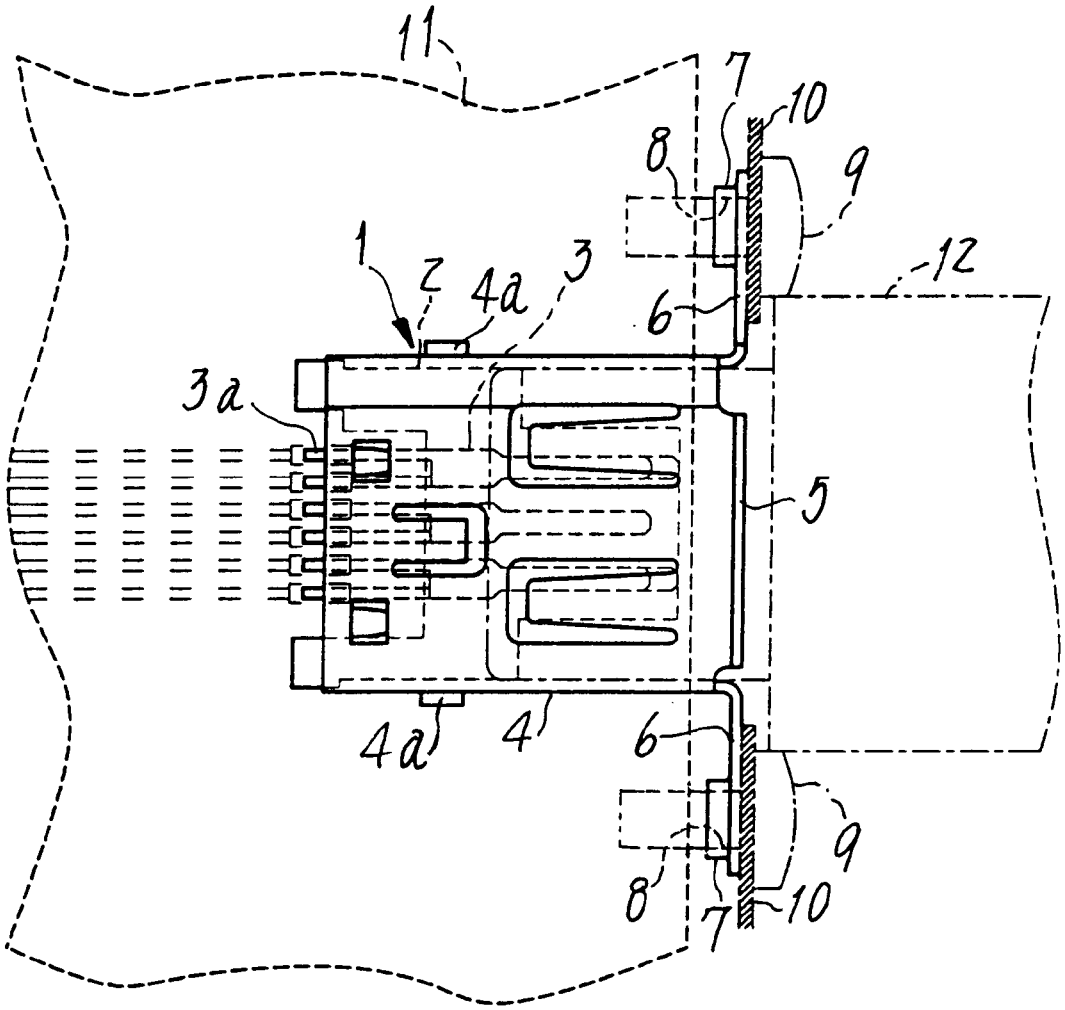
FIG.7 Prior Art
FIG. 7 is a plan view of one prior art flanged connector.

FIG. 4 shows how the flanged connector 20 as constructed above is used. In order to surface-mount the connector on the printed circuit board 11, solderable ends 22*c* of the female contacts 22 are soldered to said board, with the anchor legs 23*c* of the metal shell 23 being fitted in and also soldered to the slots (not shown). The set-screws 9 fastened in the female-threaded bores 30 secure the flanges 28 to the main body's panel 10 or the like, thus fixing thereon this flanged connector 20. The front opening 24 of such a connector 20 protrudes a distance from the front face of said panel 10. Thus, said opening 24 is ready for reception of the mating plug 12 to thereby bring into electric connection thereof with the connector. The upper and lower rounded edges 26 as well as the round edges 27*a* of the folded-back portions 27 will function to smoothly guide said plug into said connector. As apparent from FIG. 4, the set-screws' 9 heads partially protruding inwards beyond the plug's opposite sides will never interfere with this plug 12, because the flanges 28 are retracted from the front opening 24 the predetermined distance 'E'. Accordingly, these flanges 28 need no longer to jut so much outwards and sideways as those 6 in the prior art connector shown in FIG. 7. This feature will advantageously contribute to reduction in the space necessary for the flanged connector to be surface mounted.

Figure 5:
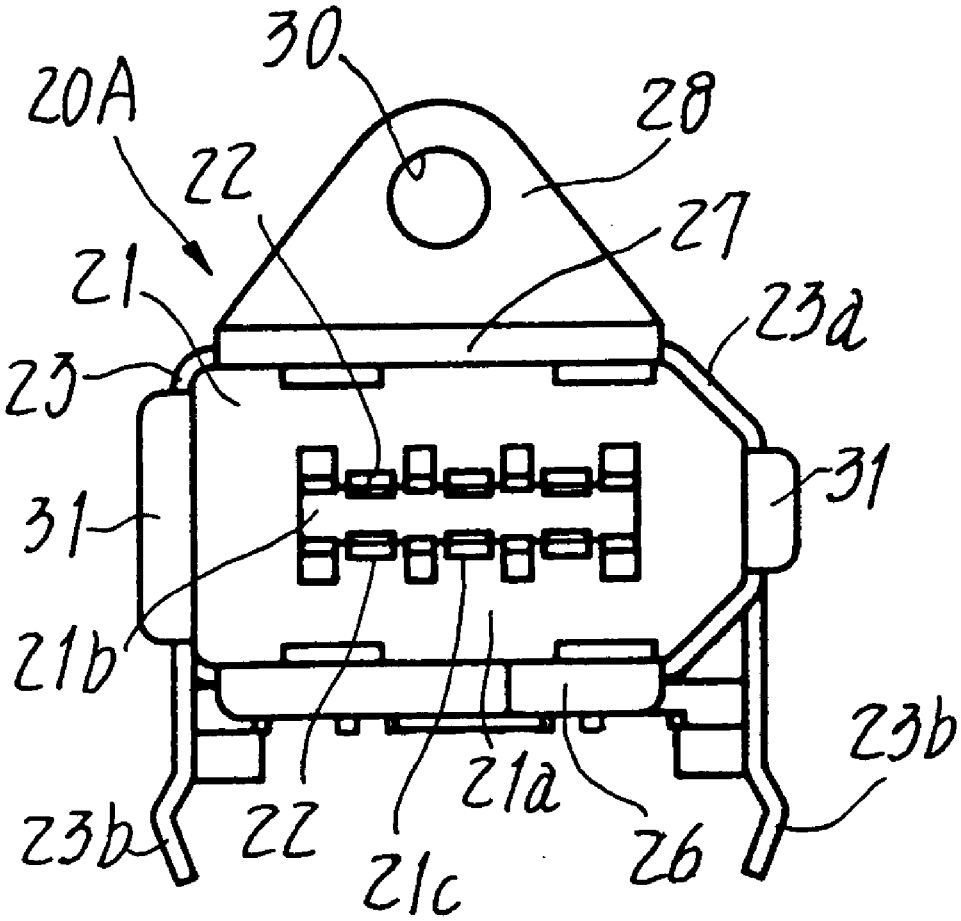
FIG. 5 is a front elevation of a further flanged connector provided in a second embodiment of the present invention.

FIG. 5 illustrates a flanged connector provided in a second embodiment. Basically, this connector 20A is almost identical with the connector 20 discussed above. Therefore, the same reference numerals are allotted to the same members or parts as those included in the already described connector, and on which members or parts description will not be repeated. Differing from the first embodiment, the upper edge of the front opening 24 in the second embodiment is bent outwards and rearwards to form a single folded-back portion 27 continuing to a single flange 28. The right-hand and left-hand edges 31 and 31 are respectively bent outwards to be rounded at their bent points.

Figure 6:
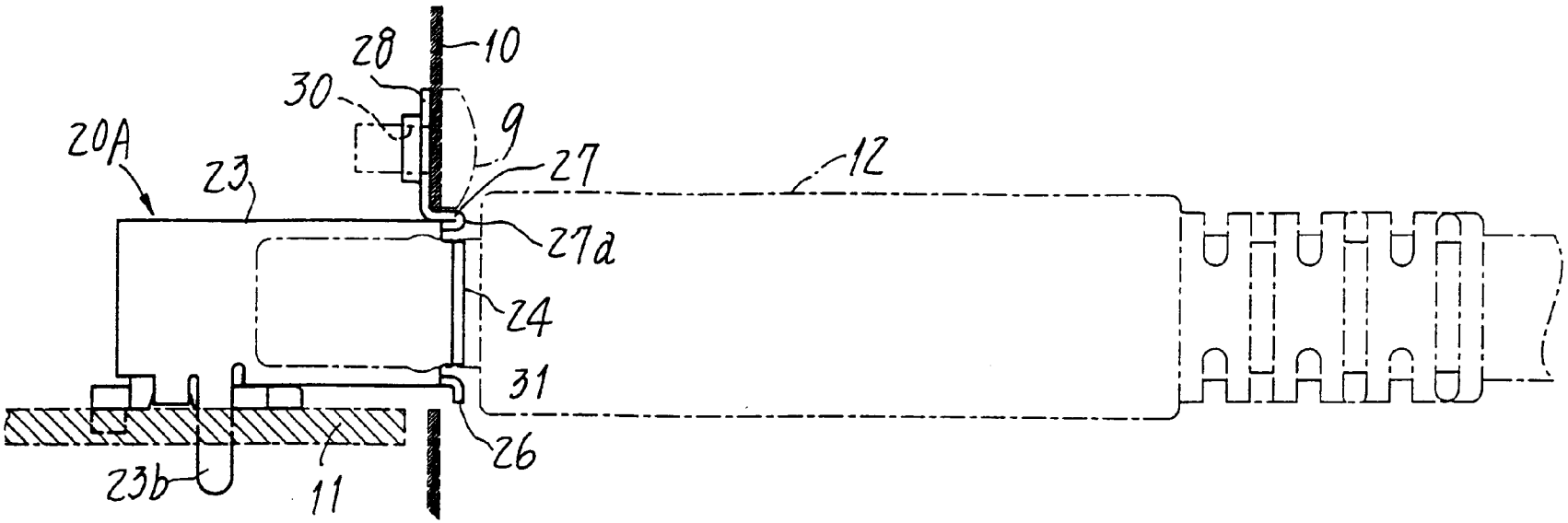
FIG. 6 is a plan view of the further flanged connector shown in use.
Figure 8:
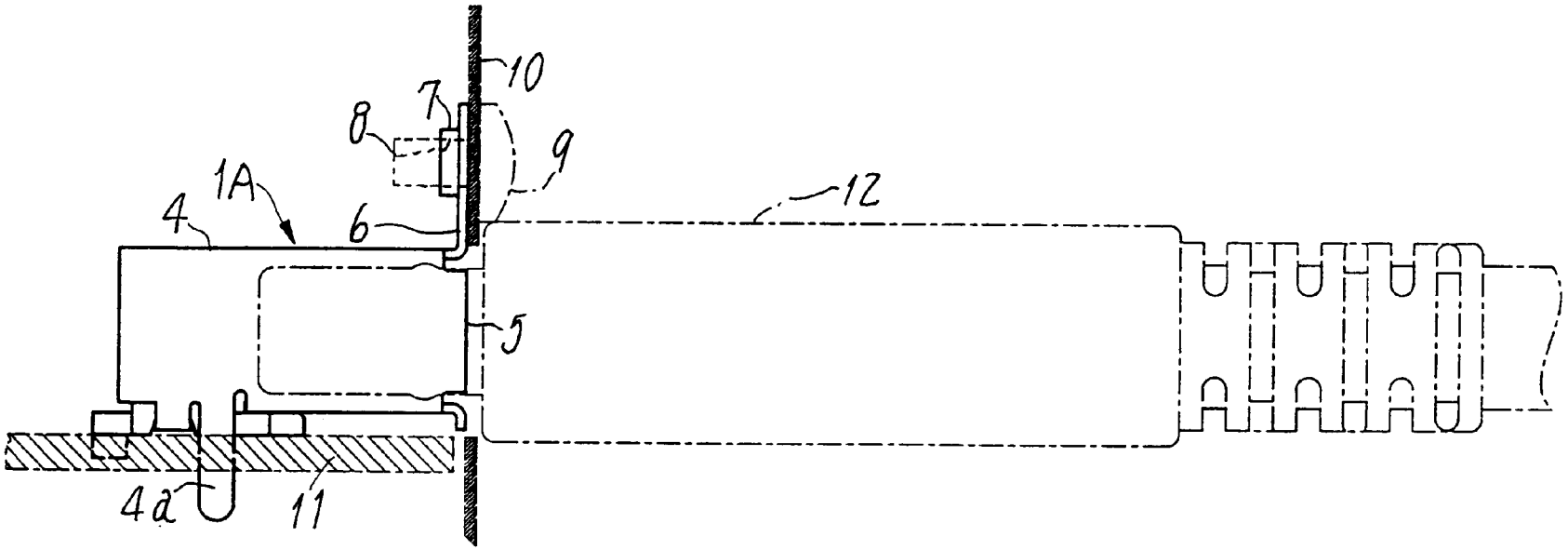
FIG.8 Prior Art
FIG. 8 is also a plan view of the other prior art flanged connector.

Also in this case, the front opening 24 of such a connector 20A protrudes a distance from the front face of the main body's panel 10 of a PC or the like. So as to be ready for reception of the mating plug 12 to thereby bring into electric connection thereof with the connector 20A. The right-hand, left-hand and lower rounded edges 31 and 26 as well as the round edge 27*a* of the folded-back portion 27 will function to smoothly guide said plug 12 into said connector. As seen in FIG. 6, the set-screw' 9 head partially protruding inwards beyond the plug's upper side will never interfere with this plug 12, because the flange 28 is retracted the predetermined distance 'E' from the front opening 24. Thus, this flange 28 need no longer to jut outwards and sideways so far as that 6 in the prior art connector shown in FIG. 8. This feature will also contribute to reduction in the pace necessary for the flanged connector 20A to be surface mounted.

In summary, the flanged connector of the present invention has one or pair of flanges that continue sideways from a folded-back portion or portions which is or are formed by bending outwards and then rearwards one or two of edges defining the front opening of the metal shell. As a result, the flange is or the flanges are retracted a distance from said edges of the opening, whereby a set-screw or set-screws for fixing said flange or flanges to a main body's panel included in a PC or the like will no longer interfere with the mating plug of a cable. A reduced space will now suffice for the connector to be surface mounted, owing to such a decreased extension of the flange or flanges.

It is also advantageous that the folded-back portion or portions for making said flange or flanges retracted from a plane in which the edges of the front opening extend is or are of such a noticeable strength as enabling said portion or portions to function as a guide or guides for the plug being inserted in said opening.

What we claim is:

1. A flanged connector comprising:

an insulating housing, a plurality of contacts separated one from another within the housing, a metal shell covering the housing so as to shield the contacts, at least one flange bent at and outwardly extending from at least one of edges of a front opening formed in the metal shell, and a female-threaded bore formed in the at least one flange, wherein the at least one flange continues from a folded-back portion that is formed by bending outwards and further bending rearwards an extension from the at least one edge so that the flange is retracted from said edges a predetermined distance at least equal to thickness of a main body's panel included in an electric or electronic apparatus.

2. A flanged connector according to claim 1, wherein two flanges as the at least one flange extend along opposite side edges as the at least one of the edges of the front opening.

3. A flanged connector according to claim 1, wherein one flange as the at least one flange extends along an upper edge as the at least one of the edges of the front opening.

4. A flanged connector according to claim 1, wherein the extension in the folded-back portion is folded back 180°, and wherein the at least one flange extends approximately perpendicularly to the folded-back portion.

5. A flanged connector according to claim 1, wherein the predetermined distance is at least equal to a sum of the thickness of the main body's panel and a thickness of a head of a set screw used to fix the flanged connector to the main body's panel by being screwed into the female threaded bore.

6. A flanged connector according to claim 5, wherein the female threaded bore is provided so that at least a portion of the set screw is provided under a periphery of a cross-sectional area of an upper face of a mating plug of a cable, the cable having male contacts which are inserted in the front opening of the metal shell to engage the contacts of the flanged connector.

7. A electronic apparatus, comprising:

a main body panel;

a printed circuit board;

a flanged connector fixed to the printed circuit board and comprising an insulating housing; a plurality of contacts separated from one another within the housing; a metal shell covering the housing and having a front opening for receiving a cable plug; at lease one flange bent at and outwardly extending from at least one edge of the front opening of the metal shell; and a female threaded bore formed in the at least one flange; wherein the at least one flange continues from a folded-back portion that is formed by bending outwards and further bending rearwards at extension from the at least one edge so that the flange is retracted from said at least one edge a predetermined distance at least equal to a thickness of the main body panel, and wherein the plurality of contacts each have a first end connected to the printed circuit board and a second end accommodated in a chamber in the insulating housing;

a set screw inserted through an opening in the main body panel and screwed into the female threaded bore in the at least one flange to fix the flanged connector to the main body panel.

8. An electronic apparatus according to claim 7, wherein the extension in the folded-back portion is folded back 180°, and wherein the at least one flange extends approximately perpendicularly to the folded-back portion.

9. An electronic apparatus according to claim 7, wherein the predetermined distance is at least equal to a sum of the thickness of the main body panel and a thickness of a head of the set screw.

10. An electronic apparatus according to claim 9, wherein the extension in the folded-back portion is folded back 180°, and wherein the at least one flange extends approximately perpendicularly to the folded-back portion.

11. An electronic apparatus according to claim 10, further comprising a cable having a mating plug having an upper face with male contacts extending therefrom, the male contacts being plugged into the chambers in the insulated housing of the flanged connector so as to electrically contact the plurality of contacts of the flanged connector, wherein at least a portion of the female threaded bore is provided under a periphery of a cross-sectional area of the upper face of the mating plug.

* * * * *